US008322082B2

(12) United States Patent
Neumann

(10) Patent No.: US 8,322,082 B2
(45) Date of Patent: Dec. 4, 2012

(54) GUTTER COVER WITH SNAP-IN HANGER ATTACHMENT

(76) Inventor: Horst Neumann, Coombs (CA)

( * ) Notice: Subject to any disclaimer, the term of this patent is extended or adjusted under 35 U.S.C. 154(b) by 0 days.

(21) Appl. No.: 12/960,513

(22) Filed: Dec. 5, 2010

(65) Prior Publication Data

US 2011/0138698 A1 Jun. 16, 2011

Related U.S. Application Data

(60) Provisional application No. 61/285,391, filed on Dec. 10, 2009.

(51) Int. Cl.
*E04D 13/076* (2006.01)

(52) U.S. Cl. ..... 52/12; 52/11; 52/15; 248/48.1

(58) Field of Classification Search ..... D23/259, D23/260, 261, 262, 263, 264, 265, 266, 267, D23/268, 269; D25/119; 52/11, 12, 13, 52/14, 15, 16; 248/48.1, 48.2
See application file for complete search history.

(56) References Cited

U.S. PATENT DOCUMENTS

| | | | | | |
|---|---|---|---|---|---|
| 3,351,206 | A | * | 11/1967 | Wennerstrom | 210/474 |
| 3,436,878 | A | * | 4/1969 | Singer | 52/12 |
| 4,467,570 | A | * | 8/1984 | Kriegel | 52/12 |
| 4,592,174 | A | * | 6/1986 | Hileman | 52/12 |
| 4,727,689 | A | * | 3/1988 | Bosler | 52/12 |
| 4,745,710 | A | * | 5/1988 | Davis | 52/12 |
| 4,905,427 | A | * | 3/1990 | McPhalen | 52/12 |
| 4,937,986 | A | * | 7/1990 | Way et al. | 52/12 |
| 5,010,696 | A | * | 4/1991 | Knittel | 52/12 |
| 5,271,191 | A | * | 12/1993 | Vahamaki | 52/12 |
| 5,375,379 | A | * | 12/1994 | Meckstroth | 52/12 |
| 6,543,729 | B1 | * | 4/2003 | Ylonen | 248/48.1 |
| 6,701,674 | B1 | * | 3/2004 | Albracht | 52/12 |
| 6,786,008 | B2 | * | 9/2004 | Brochu | 52/12 |
| D523,538 | S | * | 6/2006 | Brochu | D23/267 |
| D565,706 | S | * | 4/2008 | Murray | D23/261 |
| D586,436 | S | * | 2/2009 | Cangialosi | D23/267 |
| 7,530,200 | B2 | * | 5/2009 | Gramling | 52/11 |
| 7,752,812 | B2 | * | 7/2010 | Knudson et al. | 52/12 |
| 7,765,742 | B2 | * | 8/2010 | Ealer, Sr. | 52/12 |
| 7,891,142 | B1 | * | 2/2011 | Ealer, Sr. | 52/12 |
| 7,908,797 | B2 | * | 3/2011 | Graves | 52/12 |
| D638,920 | S | * | 5/2011 | Ealer, Sr. | D23/267 |
| 7,950,187 | B2 | * | 5/2011 | Iannelli | 52/11 |
| 7,958,677 | B2 | * | 6/2011 | Gramling | 52/11 |
| 8,001,729 | B2 | * | 8/2011 | Joly et al. | 52/12 |
| 8,099,908 | B2 | * | 1/2012 | Brochu | 52/11 |
| 8,117,785 | B2 | * | 2/2012 | Teichner et al. | 52/11 |
| D659,226 | S | * | 5/2012 | Weber | D23/267 |
| 8,191,315 | B1 | * | 6/2012 | Brochu | 52/12 |

(Continued)

FOREIGN PATENT DOCUMENTS

CA 2305159 A1 * 10/2001

(Continued)

*Primary Examiner* — Basil Katcheves
*Assistant Examiner* — Rodney Mintz
(74) *Attorney, Agent, or Firm* — Gordon Thomson

(57) ABSTRACT

Disclosed is a gutter cover comprising a elongated member adapted to fit over an existing gutter having a plurality of perforations to permit water flow and prevent clogging of the gutter with debris. The gutter cover has two raised areas on its surface to create three channels for water flow. The gutter cover can be fastened to a gutter without fasteners.

1 Claim, 5 Drawing Sheets

U.S. PATENT DOCUMENTS

| | | | | |
|---|---|---|---|---|
| RE43,555 | E * | 7/2012 | Higginbotham | 52/12 |
| 8,250,813 | B2 * | 8/2012 | Robins | 52/12 |
| 2001/0009083 | A1 * | 7/2001 | Sullivan | 52/11 |
| 2002/0166290 | A1 * | 11/2002 | Bergeron | 52/12 |
| 2003/0046876 | A1 * | 3/2003 | Higginbotham | 52/11 |
| 2004/0118052 | A1 * | 6/2004 | Brochu | 52/12 |
| 2004/0182014 | A1 * | 9/2004 | Brochu | 52/12 |
| 2004/0244302 | A1 * | 12/2004 | Neumann | 52/11 |
| 2005/0166465 | A1 * | 8/2005 | Banks et al. | 52/11 |
| 2005/0172565 | A1 * | 8/2005 | Riley et al. | 52/12 |
| 2005/0210758 | A1 * | 9/2005 | Iannelli | 52/11 |
| 2006/0196124 | A1 * | 9/2006 | Bachman | 52/12 |
| 2007/0051051 | A1 * | 3/2007 | Teichner et al. | 52/12 |
| 2007/0107323 | A1 * | 5/2007 | Higginbotham | 52/120 |
| 2007/0169423 | A1 * | 7/2007 | Brochu | 52/12 |
| 2007/0214730 | A1 * | 9/2007 | Cota | 52/12 |
| 2008/0010906 | A1 * | 1/2008 | Brochu | 52/12 |
| 2008/0047206 | A1 * | 2/2008 | Gramling | 52/12 |
| 2008/0163561 | A1 * | 7/2008 | Lenney et al. | 52/12 |
| 2008/0190039 | A1 * | 8/2008 | Brochu | 52/12 |
| 2008/0190040 | A1 * | 8/2008 | Graves | 52/12 |
| 2008/0289263 | A1 * | 11/2008 | Brochu | 52/12 |
| 2009/0013612 | A1 * | 1/2009 | Brochu | 52/12 |
| 2009/0025303 | A1 * | 1/2009 | Gramling | 52/11 |
| 2009/0031638 | A1 * | 2/2009 | Iannelli | 52/12 |
| 2009/0056234 | A1 * | 3/2009 | Brochu | 52/12 |
| 2009/0108144 | A1 * | 4/2009 | Brochu | 248/48.1 |
| 2009/0139180 | A1 * | 6/2009 | Kehs et al. | 52/741.3 |
| 2010/0071273 | A1 * | 3/2010 | Joly et al. | 52/12 |
| 2011/0041414 | A1 * | 2/2011 | Bell | 52/12 |
| 2011/0114800 | A1 * | 5/2011 | Gramling | 248/48.2 |
| 2011/0185641 | A1 * | 8/2011 | Snell | 52/12 |
| 2011/0265391 | A1 * | 11/2011 | Robins | 52/12 |
| 2011/0272344 | A1 * | 11/2011 | Higginbotham | 210/494.1 |
| 2012/0151849 | A1 * | 6/2012 | Brochu | 52/12 |

FOREIGN PATENT DOCUMENTS

| | | | |
|---|---|---|---|
| CA | 2597976 | A1 * | 2/2009 |
| CA | 2723499 | C * | 11/2011 |
| DE | 3829384 | A1 * | 3/1990 |
| EP | 2159342 | A1 * | 3/2010 |
| GB | 2138046 | A * | 10/1984 |
| WO | WO03048477 | A1 * | 6/2003 |
| WO | WO 2006015472 | A1 * | 2/2006 |
| WO | WO 2006017923 | A1 * | 2/2006 |
| WO | WO 2007108801 | A1 * | 9/2007 |
| WO | WO 2008134845 | A1 * | 11/2008 |
| WO | WO 2011070474 | A2 * | 6/2011 |
| WO | WO 2011070474 | A3 * | 8/2011 |

* cited by examiner

GUTTER COVER WITH SNAP-IN HANGER ATTACHMENT

CROSS-REFERENCE TO OTHER APPLICATIONS

This application claims the benefit of U.S. Provisional Patent Application No. 61/285,391 filed on Dec. 10, 2009.

FEDERAL FUNDING

N/A.

FIELD OF THE INVENTION

This invention relates to the field of static structures and in particular to covers with surface water receivers and specifically to a gutter cover with a snap-in hanger attachment.

BACKGROUND OF THE INVENTION

Eaves trough and gutter systems for houses and commercial buildings are well known. However, it is also well known that gutter systems can easily clog with debris such as leaves. Many systems are installed without protective covers that prevent debris from clogging the gutters and their drains. This can cause serious blockage and lead to expensive repairs. Blocked gutters can overflow and cause water leakage through the walls of a building. One example of a prior art gutter guard is U.S. Pat. No. 6,786,008 entitled "Eaves Trough with a Gutter Shield" by Brochu issued on Sep. 7, 2004. This system requires fasteners to secure the guard to the gutter and structure wall. As well, the guard over the gutter is flat and this is not an ideal way to control water flow to prevent damming and blockages on the guard due to debris. Therefore there is a need for a gutter cover with a snap-in hanger attachment that offers general improvements to the design of gutter covers and overcomes the specific deficiencies noted above.

OBJECTIVES AND ADVANTAGES OF THE INVENTION

It is one object of the invention to provide a micro-mesh screen cover that provides a protective cover for new gutter systems and old gutter systems.

It is a further object of the invention to prevent build-up of debris in gutter systems and clogging.

Another object is to protect perimeter drainage systems against blockage.

Yet another object is to prevent leakage of water through the walls of buildings.

One advantage of the invention is that it is snap-in and does not require any fasteners to be inserted into buildings.

Another advantage of the invention is that it reinforces the gutter system to handle ice and snow loads.

Yet another advantage of the invention is that if prevents gutter damage due to expansion and contraction of heavy snow and ice build-up.

SUMMARY OF THE INVENTION

The invention disclosed is a gutter cover with snap-in hanger attachment. The gutter has a back wall and an end tip. The cover has an inside support and an outside support. The cover comprises a single rolled elongate member having a predetermined length and a predetermined width to accommodate the dimensions of the gutter. The gutter cover further comprises a first end and an inside vertical upward section rising from the first end. This inside vertical upward section merges with a 180° U-shaped bend that has an inside surface. The 180° U-shaped bend merges with a first vertical downward depending section. A space is created between the inside vertical upwards section and the first vertical downward depending section to receive the gutter back wall. The inside support is achieved when the gutter back wall end tip abuts the inside surface of the 180° bend.

In another embodiment of the invention the gutter cover further comprises a raised convex-shaped section below the first vertical downward depending section. It is adapted to mesh with a convex-shaped raised section in the gutter back wall in a snap-in fit manner. This is the snap-in hanger attachment. The gutter cover can be held in place on the gutter back wall without the need for fasteners.

In another embodiment of the invention the gutter cover further comprises a second vertical downward depending section curving into a 90° bend followed by a first horizontal section. The first horizontal section is perforated with holes creating a mesh surface through which water is permitted to pass but debris is prevented.

In still another embodiment of the invention the gutter cover first horizontal section has a width that is about one-half the predetermined horizontal width of the cover.

In one embodiment of the invention the mesh holes have a density sufficient to pass enough water to prevent flooding of the gutter cover and overflow while providing adequate surface flow to clear debris from the gutter cover.

In one embodiment of the invention the gutter cover further comprises a first raised section having a convex shape followed by a second horizontal section, followed by a second raised section identical to the first raised section. The first raised section and the second raised section are separated by a distance equal to about one-quarter the predetermined width of the cover.

In yet another embodiment of the invention the gutter cover further comprises a third horizontal section extending from the second raised section to the commencement of a downwardly disposed and slightly concavely curved section. This downwardly disposed and slightly concavely curved section reverses direction at a generally "V"-shaped bend having a rounded apex. This is followed by a slightly convexly curved section which terminates at a second end. The slightly convexly curved section is un-perforated.

In one embodiment of the invention the depending concave section that dips below the end of the depending trough section creates a space between the depending section of the gutter and the depending concave section of the cover in order to channel water flow downwards into the trough and to prevent spill over of water from the surface of the cover over the top of the trough while allowing momentum to carry debris over the top of the trough and off of the cover. The slightly convexly un-perforated curved section acts as a splash guard.

In still another embodiment of the invention the first raised section and the second raised section separate the gutter cover into three parallel channels. The raised sections have three functions. The first is to provide obstructions to water flow to slow down water flow across the width of the gutter cover as water runs off an adjoining roof. This prevents the water flow from spilling off of the edge of the gutter trough. The second function is to suspend debris above the surface of the cover so that air can dry the debris and then wind can blow the debris from the gutter cover. The third function is to stiffen the covers and reinforce them to carry snow and ice.

DETAILED DESCRIPTION OF THE INVENTION

Figure 1:
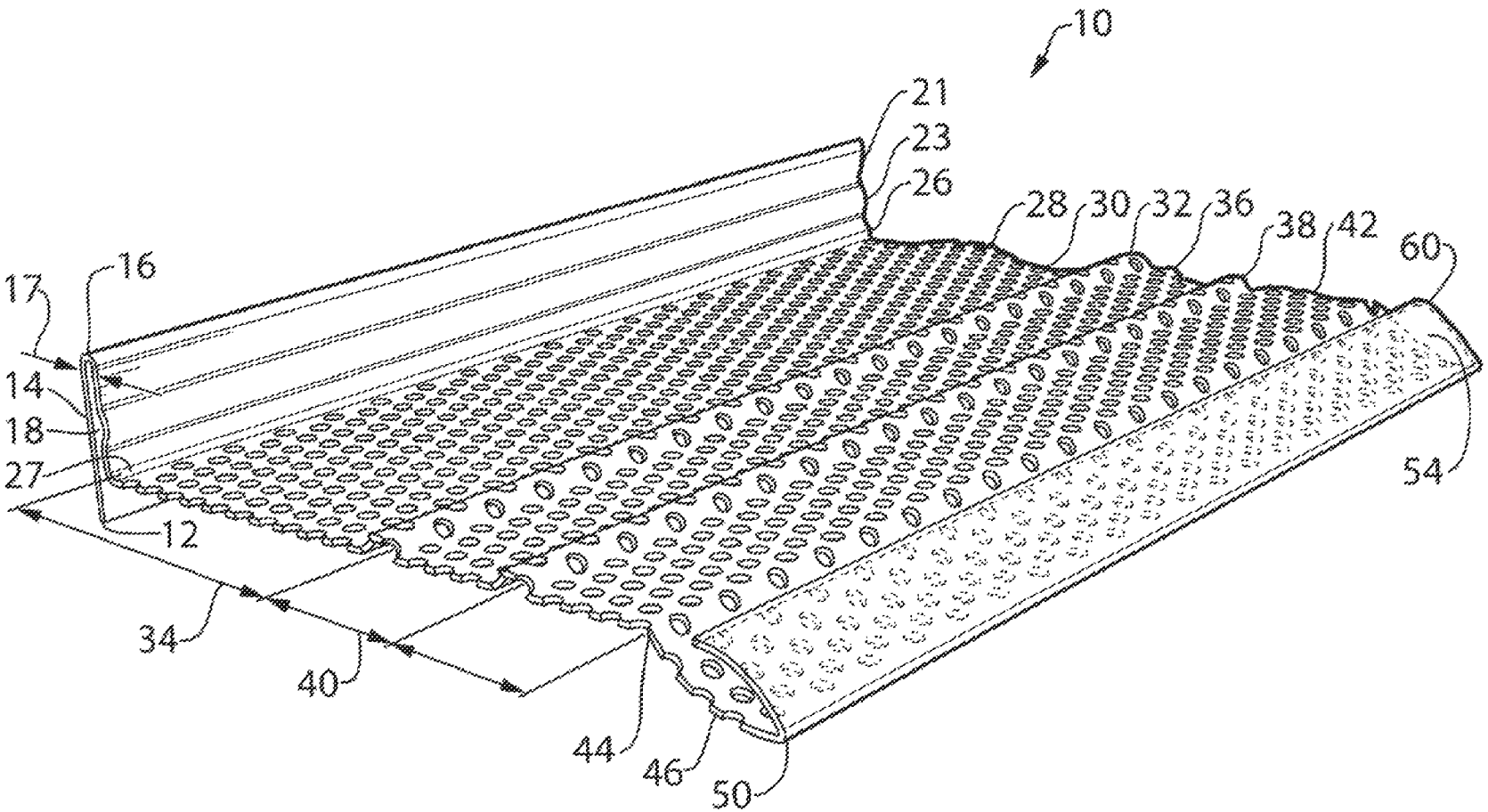
FIG. 1 is a cross-sectional perspective view of one embodiment of the invention.

Referring to FIG. 1 there is shown a perspective cross-sectional view of one first embodiment of the invention which is a mesh screen cover 10 for a gutter having a snap-in hanger attachment. The cover 10 is a single piece rolled from aluminum, stainless steel or some other suitable material that is malleable for rolling and resistant to rust. Generally the width of the cover is made to suit the dimensions of the gutter being covered which can vary. Typical sizes are 5 inches wide and 6 inches wide. The length of the cover can be any suitable continuous length.

Referring to FIG. 1, the cover is a single member comprising a first end 12 from which rises an inside (left) vertical upward section 14. Vertical section 14 merges with a 180° U-shaped bend 16. The U-shaped bend 16 creates a space 18 between vertical section 14 and vertical downwards section 21. This space 18 has a width 17 that is able to receive a gutter back wall 22 as illustrated in FIG. 2.

Still referring to FIG. 1, the cover 10 further comprises vertical downwards section 21 merging with a raised convex-shaped section 23. Convex-shaped section 23 is adapted to mesh in a snap-in fashion with convex-shaped section 24 illustrated in the back wall 22 of the gutter as shown in FIG. 2. This snap-in meshing of section 23 and section 24 creates the fastener-less hanger attachment which holds the cover in place without the need for fasteners such as screws which may break the antirust coating and paint seals of the gutter and damage the siding or roofing member to which the gutter is attached.

Still referring to FIG. 1, after the convex-shaped section 23, there is continued downwards vertical section 26 which curves into a 90° angle 27 and then merges into a first horizontal section 28. This first horizontal section 28 is perforated with holes 30 creating a mesh surface through which water is permitted to pass but debris is prevented. The density of the mesh holes 30 is sufficient to prevent flooding of the cover and overflow of the cover while providing adequate surface flow to clear debris from the top surface of the cover. The mesh holes also permit air flow through and around debris that might settle on the cover after a rain storm. This dries the debris and facilitates wind motion blowing the debris off of the cover to keep it clean. The first horizontal section 28 meets a first raised section 32 having a convex shape. The first raised section 32 is about half-way across the top surface of the cover shown as distance 34 from the angle 27. After the first raised section 32 there is a second horizontal section 36 which meets a second raised section 38 having a convex shape. The distance between the first raised section 32 and the second raised section 38 is distance 40 which is about half the distance 34. A third horizontal section 42 extends from the second raised section 38 to the commencement 44 of a downwardly disposed and slightly concavely curved section 46. Slightly curved section 46 reverses direction at 50 which is a generally "V"-shaped bend having a rounded apex. The cover continues from bend 50 into a slightly convexly section 54 which terminates at a second end 60. Sections 28, 32, 36, 38, 42 and 44 are perforated having the same density of holes as first horizontal section 28. Section 54 is a solid section with no perforations.

Figure 2:
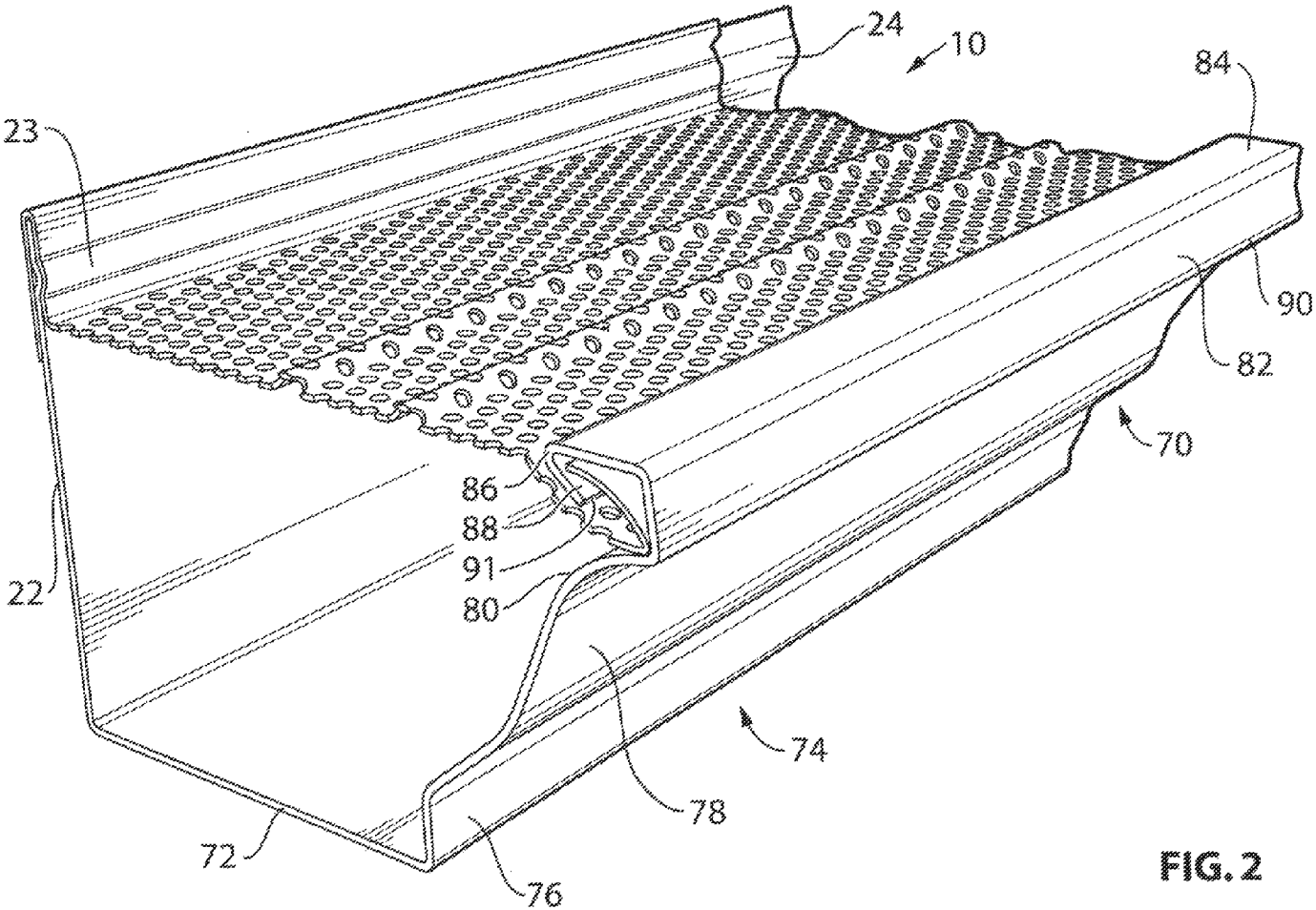
FIG. 2 is a cross-sectional perspective view of one embodiment of the invention installed in a typical gutter.

Referring now to FIG. 2, there is illustrated one embodiment of the invention cover 10 in a typical gutter section 70. The gutter section 70 comprises a back wall 22 a bottom wall 72 and a front wall 74. The front wall 74 comprises, in succession, a first vertical section 76 a first convex curved section 78 a first concave curved section 80, a first 90° angle, a second vertical section 82, a second 90° angle 93, a first horizontal section 84, a first "V"-shaped angle 86 followed by a depending section 88 terminating in an end 91. As previously identified, the back wall 22 includes a concave section 24 adapted to mesh in a snap-in with the concave section 23 on the gutter cover to form the hanger attachment without fasteners.

Figure 3:
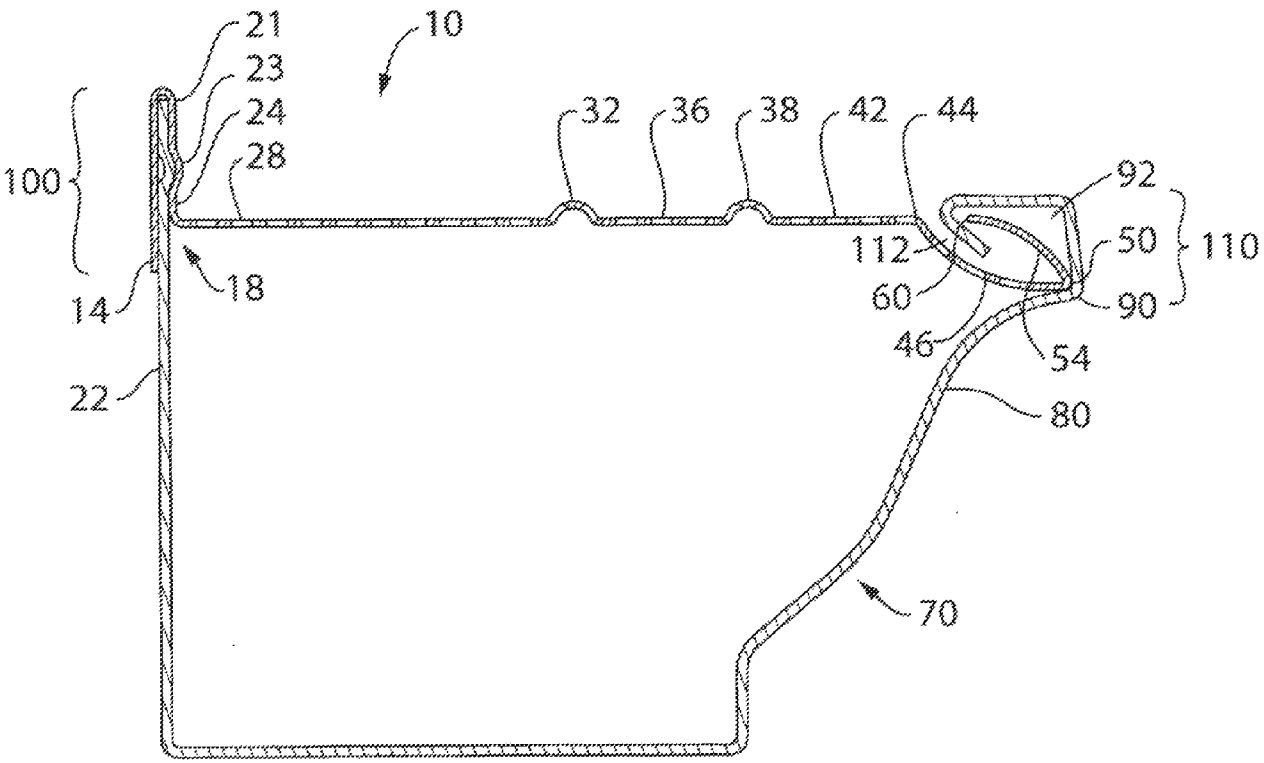
FIG. 3 is a cross-sectional side view of one embodiment of the invention installed in a typical gutter.
Figure 4:
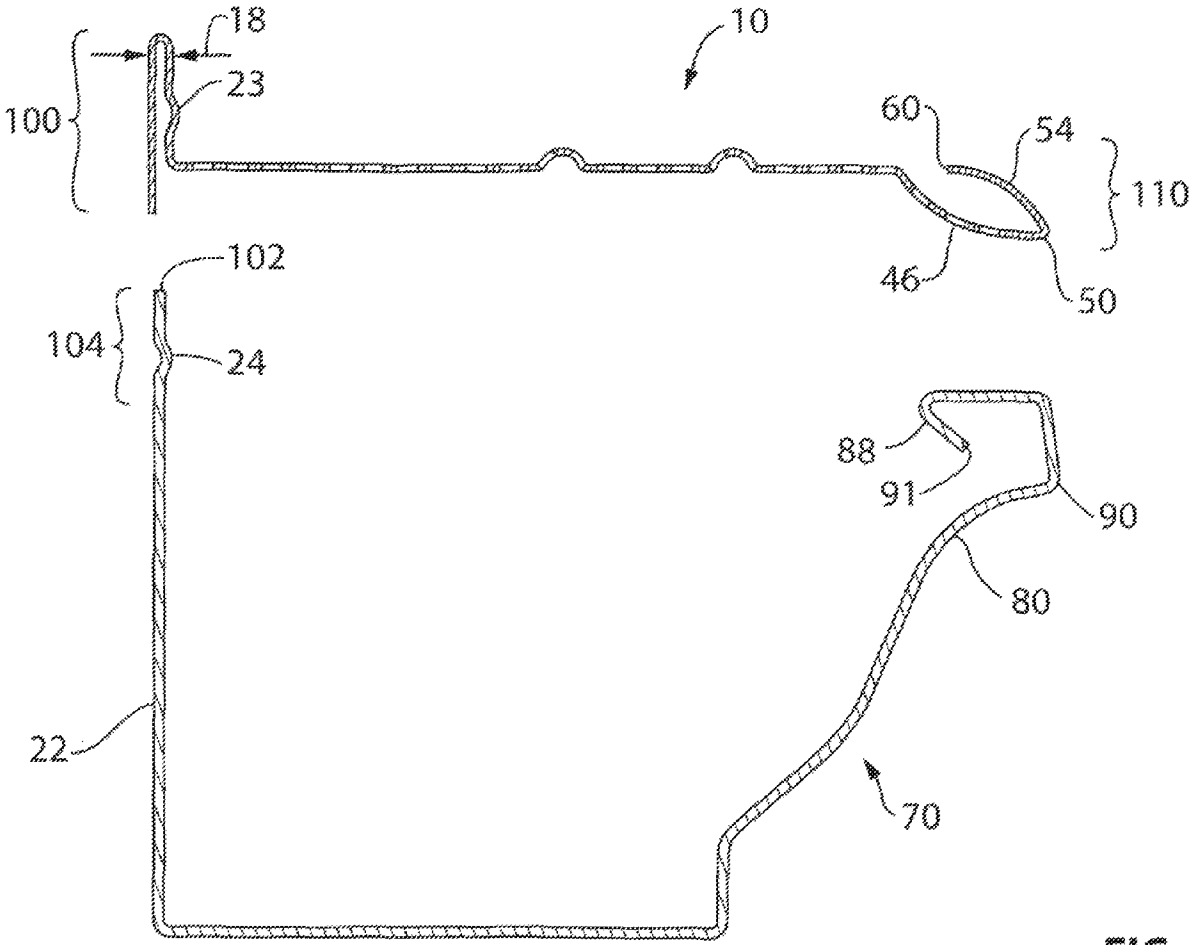
FIG. 4 is a cross-sectional side view of one embodiment of the invention disposed above a typical gutter.

Referring now to FIG. 3 and FIG. 4, there is shown a cross-sectional side view of one embodiment of the invention cover 10 installed on a typical gutter profile 70. In particular this figure shows the supporting relationship between sections 46 and 54 and angles 44 and 50 of the cover 10 with the angle 90 and cavity 92 of the trough 70. As previously explained, the back wall 22 of the gutter profile 70 supports the back portion 100 of the cover 10. The space 18 between cover section 14 and cover sections 21, 23 and 24 has a width 17 sufficient to accept the tip 102 and top end portion 104 of back wall 22. Concave section 24 meshes with concave section 23 in a snap-in fashion to support the cover 10 without any additional fasteners. The front portion 110 of the cover 10 is supported at the contact between cover angle 50 and trough angle 90. There is further supporting contact between a front portion of cover section 46 and concave section 80 of the front wall 74 of the trough 70. It is advantageous that there is no other contact point between the front of the cover and the trough. This eliminates any unnecessary frictional contact between the cover and trough which may result in penetrating the anti-rust seals of the trough such as might occur if end 60 were to contact any portion of the trough.

Still referring to FIG. 3 and FIG. 4 and another advantage of the cover 10 of the invention is that the depending concave section 46 dips below the end 91 of the depending trough section 88. This creates a space 112 between the depending section of the trough 88 and the depending section of the cover 46 which channels water flow downwards into the trough and prevents spill over of water from the surface of the cover over the top of the trough while allowing debris to carry over over the top of the trough and off of the cover 10. A further advantageous feature of section 54 of the cover 10 is that it does not have any perforations and so water will not carry fines into the cavity 92 of the trough. In effect, section 54 acts as an effective splash guard.

Referring now to FIGS. 1, 2 and 3 there is explained a further advantage of the invention. The raised sections 32 and 38 create three parallel channels in the cover 10, namely, horizontal sections 28, 36 and 42. Rather than use a single horizontal channel on the surface of the cover the present invention uses two raised sections to create three channels to ensure that water velocity from, say a roof line, and across the width of top surface of the cover is sufficiently reduced to fall into the trough through the mesh. Without the raised areas and with a high velocity and volume of water rushing onto the cover, water would run over the top of the gutter trough and onto the ground creating unsightly holes as well as staining the visible outside area of the trough. The raised sections 32 and 38 act to slow the flow of water and therefore decrease the velocity of water flowing over the channels 28, 26 and 42. This permits water to fall into the trough. The raised sections also act to suspend debris above the cover so that air flow can dry the debris and wind can blow the debris off of the cover. This prevents debris from sticking to and clogging the apertures in the cover. The raised sections 32 and 38 also act to reinforce the cover and stiffen it so that it can support ice and snow loads more readily than a flat surface.

FIGS. 2 and 3 illustrate that the cover 10 sits slightly below the top horizontal surface 84 of the trough. This permits easy cleaning of debris from the surface of the cover by an individual as well as allowing natural wind flow to blow debris from the cover. The gap 112 traps water flowing towards the horizontal surface 84 so there is no spill over the top of the trough while the momentum of debris carried by the water may take it over the top of the trough and off of the cover.

Figure 5:
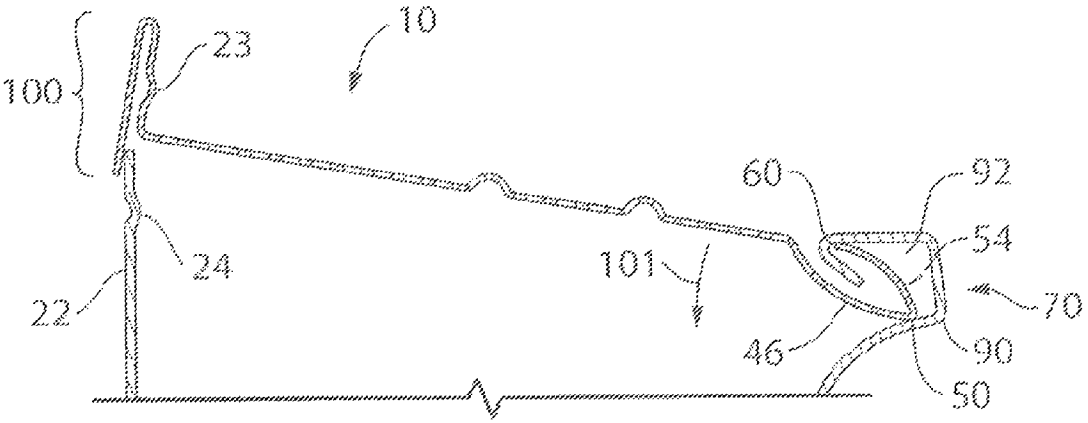
FIG. 5 is a cross-sectional side view of one embodiment of the invention in the first position of an installation sequence.
Figure 6:
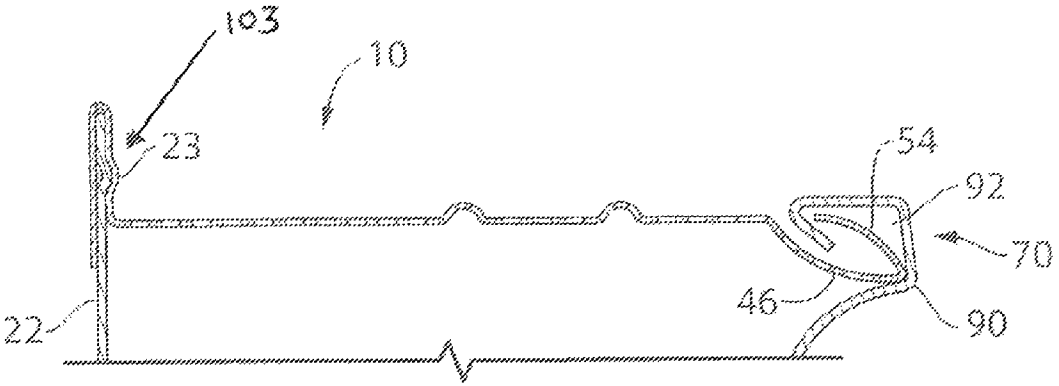
FIG. 6 is a cross-section side view of one embodiment of the invention in the second position of an installation sequence.

Referring now to FIG. 5 and FIG. 6 there is illustrated a further advantage of this invention 10, that is, its snap-in device 103 making installation with fasteners easier. To install the invention 10 into a gutter trough 70 the front portion 110 of the cover comprising section 46, section 54 and angle 50 is inserted into cavity 92. Cover end 60 is inserted into cavity 92 first. Then the cover is pivoted downwards 101 so that angle 50 is seated into angle 90 of the trough. The rear portion 100 of the cover is then placed over the back wall 22 of the trough as illustrated in FIG. 5 and pushed downwards so that the snap-in device is engaged when raised section 24 on the back wall of trough meshes in a snap-in fashion with raised section 23 of the cover. In this way the cover is locked tightly in place over the top surface of the trough without any fasteners. The high back wall on the cover prevents splashing of water onto the supporting building and staining.

The cover is apertured with 0.125 inch holes. The cover is fabricated from 0.032 inch thick material. Approximately 30% of the surface are of the cover is covered with holes which will keep 90% of the debris out of the gutter.

It can be seen from the foregoing disclosure that the invention provides for a maintenance free system without need to clean gutters or screen covers. The cover can be cut to any desired length and may have any necessary width to accommodate a variety of trough profiles.

This description contains much specificity that should not be construed as limiting the scope of the invention but merely provides illustrations of some of its embodiments. Thus the scope of the invention should be determined by the appended claims and their legal equivalents rather than by the examples given.

What is claimed is:

1. A system, comprising:

a gutter, said gutter comprising a front end cavity, a front horizontal surface and a back wall having a tip and a gutter first convex-shaped protrusion extending longitudinally there-on; and a gutter cover for placement on the gutter, wherein said gutter cover comprises:

a) a sieved first, second and third horizontal surfaces wherein said first and second horizontal surfaces are separated by a first sieved raised projection and wherein said second and third horizontal surfaces are separated by a second sieved raised projection;

b) a first support within said front end cavity and a second support on said back wall tip so that said sieved horizontal surfaces, when installed, are flush with said gutter front horizontal surface;

c) a first end and an inside vertical section rising from said first end, said inside vertical section merging with a 180° U-shaped bend;

d) said 180° U-shaped bend having an inside surface, the 180° U-shaped bend merging with a depending outside vertical section;

e) said depending outside vertical section creating a space between the inside vertical section and said depending outside vertical section, wherein said space has a width adapted to receive said back wall so that said back wall tip abuts said inside surface of the 180° U-shaped bend thereby forming said second support;

f) a second convex-shaped protrusion extending longitudinally on the depending outside vertical section;

g) a snap-in device comprising said second convex-shaped protrusion in compression over and against said gutter first convex-shaped protrusion;

h) a 90° bend joining said depending outside vertical section with the sieved first horizontal surface;

i) a gap between the sieved third horizontal surface and the gutter front horizontal surface to redirect water flow from the sieved third horizontal surface onto a downwardly and concave curved and sieved section;

j) said downwardly and concave curved and sieved section for draining water entering said gap into the gutter, wherein the downwardly and concave curved section reverses direction at a "V"-shaped bend having a rounded apex and continues as an un-sieved and convexly curved section which terminates at a gutter cover second end.

* * * * *